US006406568B1

(12) United States Patent
Agarwal et al.

(10) Patent No.: US 6,406,568 B1
(45) Date of Patent: Jun. 18, 2002

(54) 18-KARAT GREEN GOLD ALLOY COMPOSITIONS

(75) Inventors: Dwarika P. Agarwal, Attleboro; Grigory Raykhtsaum, Sharon, both of MA (US)

(73) Assignee: Leach & Garner Company, North Attleboro, MA (US)

( * ) Notice: Subject to any disclaimer, the term of this patent is extended or adjusted under 35 U.S.C. 154(b) by 0 days.

(21) Appl. No.: 09/935,114

(22) Filed: Aug. 22, 2001

(51) Int. Cl.[7] ..... C22C 5/00
(52) U.S. Cl. ..... 148/430; 148/405; 420/511
(58) Field of Search ..... 420/511; 148/430, 148/405

(56) References Cited

U.S. PATENT DOCUMENTS 5,180,551 A * 1/1993 Agarwal ..... 420/511

FOREIGN PATENT DOCUMENTS

GB 2279662 * 1/1995

JP 04074836 * 3/1992

OTHER PUBLICATIONS

G. Raykhtsaum et al., "The Color of Gold", A.J.M. (Oct. 1994), MJSA, One State Street, 6th flr. Providence, RI 02908–5035.

* cited by examiner

*Primary Examiner*—Sikyin Ip
(74) *Attorney, Agent, or Firm*—Phillips, Lytle, Hitchcock, Blaine & Huber LLP

(57) ABSTRACT

An improved 18-karat green gold alloy composition comprises about 75.0% gold; about 6.0–7.0% silver; about 9.0–11.7% copper; and about 6.5–9.0% zinc. The improved alloys are capable of being age-hardened to a hardness of about 240 VHN by being heated to about 550° F. for about one hour, and thereafter being permitted to cool in air. The hard-nesses of the alloys are reversible between their aged-hardness and annealed-hardness values. The color of said composition is between about −1.5 to about −3.0 CieLab a* color units, and between about 19 to about 26 CieLab b* color units.

7 Claims, No Drawings

18-KARAT GREEN GOLD ALLOY COMPOSITIONS

TECHNICAL FIELD

The present invention relates generally to gold alloy compositions, and, more particularly, to improved 18-karat green gold alloy compositions.

BACKGROUND ART

Traditionally, 18-karat green gold alloys have been used to provide a color contrast to other alloys in multicolored jewelry articles, such as bracelets, necklaces and the like. Most existing 18-karat green gold alloys are based on a familiar gold-silver-copper system, and typically contain high concentrations of silver. These green golds are fairly soft and cannot be appreciably age-hardened.

The color of gold alloy compositions is no longer a matter of subjective impression. Rather, color is now determined objectively in terms of its component colors a (green-red) and b* (blue-yellow) on a CieLab color-measuring system. See, e.g., G. Raykhtsaum et al., "The Color of Gold", *A. J. M.* (October 1994), the aggregate disclosure of which is hereby incorporated by reference.

Moreover, some gold alloys have been developed that offer the capability of reversible hardness, by selective application of an appropriate heat treatment, between their annealed-hardness and aged-hardness values. In many cases, there is a considerable disparity between these hardnesses. Hence, an alloy may be annealed to lower its hardness value. This allows the alloy to be worked more easily. After the alloy has been worked, as by forming an article of jewelry therefrom, the item may be aged-hardened to a higher hardness value to increase its resistance to denting and deformation. However, if there is a subsequent need to rework or repair the item, it may be annealed to reduce its hardness to its annealed-hardness value. After the item has been reworked or repaired, it may be age-hardened to a higher hardness value. Other gold alloys having this "reversible" hardness feature are shown and described in U.S. Pat. No. 5,180,551, the aggregate disclosure of which is hereby incorporated by reference.

For example, one alloy, denominated as Alloy 1 herein, contains about 75.0% gold, about 22.5% silver, and about 2.5% copper. This alloy has an annealed hardness of about 100 Vickers Hardness Number ("VHN"). While this has an acceptable green color, it cannot be age-hardened to a substantially greater value.

In an attempt to increase the hardness, the concentration of silver has been lowered. However, as the silver content decreases, these alloys have been found to lose there greenish tint. For example, another known alloy, designated Alloy 2 herein, contains about 75% gold, about 16% silver, and about 9% copper. This alloy was found to have an annealed hardness of about 130 VHN, and was capable of being age-hardened to about 170 VHN. However, the hardenability of this alloy was at the expense of its color. Rather than being a green, this alloy had a pale-yellow color.

Further decreases in the silver concentration has led to a pronounced color shift from green to yellow. For example, a third prior art alloy, designated Alloy 3 herein, contains about 75.0% gold, about 12.5% silver, and about 12.5% copper. This alloy was found to have an annealed hardness of about 150 VHN, and was capable of being age-hardened to about 250 VHN. However, the color of this alloy was found to be yellow.

None of these known prior art alloys is believed to: (1) have an attractive green color, and (2) be capable of reversible hardening between its annealed hardness value and its aged-hardness value.

Accordingly, it would be generally desirable to provide improved 18-karat green gold alloy compositions that retain their desirable green gold color, and are capable of being selectively hardened and softened, at will, between their annealed and aged-hardness values.

DISCLOSURE OF THE INVENTION

The present invention provides various improved 18karat green gold alloy compositions that are capable of being reversibly hardened and softened between their annealed and aged-hardness values.

The improved alloy compositions broadly comprise: about 75.0% gold; about 6.0–7.0% silver; about 9.0–11.7% copper being age-hardened to a hardness of at least about 240 VHN by being heated to about 550 ° F. for about one hour, and thereafter being permitted to cool in air.

The improved compositions may further comprise about 0.3% cobalt, about 0.005% iridium and/or about 0.5–1.9% indium. A first preferred embodiment contains about 75.0% gold, about 7.0% silver, about 10.7% copper, about 7.0% zinc, and about 0.3% cobalt. A second preferred embodiment contains about 75.0% gold, about 7.0% silver, about 10.2% copper, about 7.0% zinc, about 0.3% cobalt, and about 0.5% indium. The annealed condition of the alloys obtained by heating the composition to about 1150° F. for about thirty minutes, followed by quenching in water. The age-hardening condition is obtained by heating the composition to about 550° F. for about one hour, after which the composition is permitted to cool in air.

With the improved alloys, the aged-hardness is about 1.33–2.0 times greater than the annealed hardness obtained by these conditions. Moreover, the hardness of the alloys is reversible between its annealed and aged-hardness values. This means that an annealed alloy may be selectively age-hardened to a greater hardness value by heating the alloy to about 550° F. for about one hour, and by thereafter allowing the composition to cool in air. Conversely, an age-hardened alloy may be softened by heating the alloy to about 1150° F. for about thirty minutes, followed by a water quench. Thus, the hardness of the alloys is controllably reversible between the annealed and aged-hardness values. This is highly desirable because it allows the alloy to be worked or formed in its softer annealed state. Thereafter, a particular article may be age-hardened to a greater hardness value. If the item is ever in need of repair, its hardness may be reduced by heating the article to about 1150° F. for about thirty minutes, and by quenching in water. After being reworked or repaired, the article may be again age-hardened to a greater hardness value by heating the alloy to about 550° F. for about one hour, and by allowing the piece to cool in air. Hence, the hardness of the alloy is selectively reversible. Importantly, the improved alloys have been found to exhibit a desirable green color, which ranges between about 1.5 to about 3.0 CieLab a* units, and between about 19 to about 26 CieLab b* units.

These and other objects and advantages will become apparent from the foregoing and ongoing written specification, and the appended claims.

DESCRIPTION OF THE PREFERRED EMBODIMENTS

As indicated above, the present invention broadly provides various improved 18-karat green gold alloy compositions. The improved compositions broadly include: about 75.0% gold; about 6.0% to about 7.0% silver; about 9.0% to about 11.7% copper; and about 6.5% to about 9.0% zinc.

The improved alloys are capable of being age-hardened to a hardness of about 240 VHN by being heated to about 550° F. for about one hour, and there-after being permitted to cool to room temperature in air.

The improved alloy compositions may further comprise about 0.3% cobalt and/or about 0.005% iridium. The composition may further comprise about 0.5% to about 1.9% indium.

The aged-hardness values of the improved alloys is about 1.33 to about 2.0 times their annealed-hardness values. Such annealed hardness are obtain by heating the composition to about 1150° F. for about thirty minutes, followed by water quenching. One unique feature of the invention is that the hardnesses of the improved alloys may be selectively reversed between their annealed and aged conditions simply by an appropriate heat treatment. For example, an annealed alloy may be age-hardened to a greater value by heating it to about 550° F. for about one hour, and thereafter allowing the alloy to cool in air. Conversely, the hardness of an age-hardened alloy may be reduced to its annealed value by heating the alloy to about 1150° F. for about thirty minutes, followed by a water quenching. The improved alloys retain a desirable green color ranging from about −1.5 to about −3.0 CieLab a* units, and between about 19 to about 26 CieLab b* units.

Table 1, which is reproduced below, shows the composition of two prior art alloys mentioned above.

TABLE 1

| | Composition | | | | | | | Hardness | | CieLab Color | |
|---|---|---|---|---|---|---|---|---|---|---|---|
| Alloy | % Au | % Ag | % Cu | % Zn | % Co | % Ir | % In | Ann'l | Aged | a* | b* |
| 1 | 75.0 | 22.5 | 2.5 | | | | | 100 | — | −4.5 | 27.0 |
| 2 | 75.0 | 16.0 | 9.0 | | | | | 130 | 170 | 0.4 | 24.5 |

The first of these alloys, Alloy 1, contains about 75% gold, about 22.5% silver and about 2.5% copper. This alloy was found to have an acceptable green color, but had an annealed hardness of only about 100 VHN. However, it was found that this composition could not be significantly age-hardened. As used herein, a difference between the age-hardened and annealed hardness values of less than 15% is not considered to be significant.

The second alloy, designated Alloy 2, comprises about 75.0% gold, about 16.0% silver and 9.0% copper. This alloy was found to have an annealed hardness of about 130 VHN, and was capable of being age-hardened to about 170 VHN. However, even this limited harden-ability was achieved at the expense of its color. In fact, this Alloy 2 exhibited a pale-yellow color. The compositions and properties of Alloys 1 and 2 are listed in Table 1.

Table 2 lists the composition of a third alloy, Alloy 3, that contains about 75.0% gold, about 12.5% silver, and about 12.5% copper.

TABLE 2

| | Composition | | | | | | | Hardness | | CieLab Color | |
|---|---|---|---|---|---|---|---|---|---|---|---|
| Alloy | % Au | % Ag | % Cu | % Zn | % Co | % Ir | % In | Ann'l | Aged | a* | b* |
| 3 | 75.0 | 12.5 | 12.5 | | | | | 150 | 250 | 3.4 | 23.0 |

This alloy was found to have an annealed hardness of about 150 VHN, and could be age-hardened to about 250 VHN. Thus, Alloy 1 has an unacceptable color, and shows no reversible hardening. Alloy 2 shows a limited hardening and an unacceptable color. Alloy 3 has a full reversible hardening characteristic, but its color is unacceptable. Therefore, none of these prior art alloys is believed to (1) have an attractive green color, and (2) be capable of reversible hardening between its annealed hardness value and its age-hardness value.

Table 3 lists the compositions and properties of certain alloys, designated Alloys 4–11, that have an acceptable color, and are capable of reversible hardness, at will, between their annealed-and aged-hardness values.

TABLE 3

| | Composition | | | | | | | Hardness | | CieLab Color | |
|---|---|---|---|---|---|---|---|---|---|---|---|
| Alloy | % Au | % Ag | % Cu | % Zn | % Co | % Ir | % In | Ann'l | Aged | a* | b* |
| 4 | 75.0 | 7.0 | 10.0 | 8.0 | | | | 180 | 240 | −2.2 | 20.5 |
| 5 | 75.0 | 7.0 | 10.7 | 7.0 | 0.3 | | | 140 | 240 | −1.7 | 21.0 |
| 6 | 75.0 | 6.5 | 11.7 | 6.5 | 0.3 | | | 145 | 250 | −1.0 | 21.0 |
| 7 | 75.0 | 6.5 | 9.195 | 9.0 | 0.3 | 0.005 | | 150 | 255 | −2.4 | 20.5 |
| 8 | 75.0 | 6.0 | 10.0 | 9.0 | | | | 165 | 240 | −2.0 | 20.5 |
| 9 | 75.0 | 7.0 | 9.0 | 9.0 | | | | 165 | 240 | −2.3 | 20.5 |
| 10 | 75.0 | 6.9 | 9.0 | 6.9 | 0.3 | | 1.9 | 125 | 250 | −2.0 | 20.5 |
| 11 | 75.0 | 7.0 | 10.2 | 7.0 | 0.3 | | 0.5 | 135 | 250 | −1.7 | 21.5 |

Thus, Alloy 4 has about 75.0% gold, about 7.0% silver, about 10.0% copper, and about 8.0% zinc. This alloy had an annealed hardness of about 180 VHN, and could be age-hardened to about 240 VHN. This alloy also exhibited acceptable color, and its CieLab color units are indicated in Table 3.

Alloy 5 contained about 75.0% gold, about 7.0% silver, about 10.7% copper, about 7.0% zinc, and about 0.3% cobalt. This alloy had an annealed hardness of about 140 VHN, and could be age-hardened to about 240 VHN. This alloy also possessed an acceptable green color, and its CieLab color units are indicated in Table 3.

Alloy 6 contained about 75.0% gold, about 6.5% silver, about 11.7% copper, about 6.5% zinc, and about 0.3% cobalt. This alloy had an annealed hardness of about 145 VHN, and could age-hardened to about 250 VHN. This alloy also possessed an acceptable green color, and its CieLab color units are indicated in Table 3.

Alloy 7 contained about 75.0% gold, about 6.5% silver, about 9.195% copper, about 9.0%, about 0.3% cobalt, and about 0.005% iridium. This alloy was found to have an annealed hardness of about 150 VHN, and could be age-hardened to about 255 VHN. This alloy was also found to have an acceptable green color, and its CieLab color units are indicated in Table 3.

Alloy 8 had about 75.0% gold, about 6.0% silver, about 10.0% copper, and about 9.0% zinc. This alloy had an annealed hardness of about 165 VHN, and was capable of being age-hardened to about 240 VHN. This alloy also had an acceptable green color, and its CieLab color units are indicated in Table 3.

Alloy 9 had about 75.0% gold, about 7.0% silver, about 9.0% copper, and about 9.0% zinc. This alloy had an annealed hardness of about 165 VHN, and was capable of being age-hardened to about 240 VHN. Alloy 9 also had an acceptable green color, and its CieLab color units are indicated in Table 3.

Alloy 10 had about 75.0% gold, about 6.9% silver, about 9.0% copper, about 6.9% zinc, about 0.3% cobalt, and about 1.9% indium. This alloy had an annealed hardness of about 125 VHN, and was capable of being age-hardened to about 250 VHN. Alloy 10 also had an acceptable green color, and its CieLab color units are indicated in Table 3.

Alloy 11 contained about 75.0% gold, about 7.0% silver, about 10.2% copper, about 7.0% zinc, about 0.3% cobalt, and about 0.5% indium. This alloy had an annealed hardness of about 135 VHN, and aged-hardness of about 250 VHN. Here again, this alloy contained an acceptable green color, and its CieLab color units are indicated in Table 3.

As indicated above, Alloys 4–11 represent the improved alloys that are disclosed and claimed herein. Each of these alloys possessed an acceptable green gold color, and was capable of being age-hardened to about 1.33 to about 2.0 times its annealed hardness. The conditions for the annealed and aged-hardness have been separately given herein. Moreover, these hardness values were reversible in that the alloys could be selectively hardened or softened by an appropriate heat treatment.

Table 4 gives the particulars of Alloys 12–18. These alloys, some of which were experimental and others of which were commercially available, generally possess an acceptable green color, but are not hardenable to the extent of the alloys set forth in Table 3.

TABLE 4

| | Composition | | | | | | | Hardness | | CieLab Color | |
|---|---|---|---|---|---|---|---|---|---|---|---|
| Alloy | % Au | % Ag | % Cu | % Zn | % Co | % Ir | % In | Ann'l | Aged | a* | b* |
| 12 | 75.0 | 13.0 | 8.0 | 4.0 | | | | 140 | — | −2.2 | 23.0 |
| 13 | 75.0 | 9.0 | 8.7 | 7.0 | 0.3 | .0005 | | 135 | — | −2.1 | 21.5 |
| 14 | 75.0 | 8.5 | 10.0 | 7.5 | | | | 160 | 190 | −1.8 | 20.5 |
| 15 | 75.0 | 14.5 | 7.5 | 3.0 | | | | 150 | — | −1.8 | 24.0 |
| 16 | 75.0 | 16.2 | 7.3 | 1.5 | | | | 160 | — | −1.5 | 24.0 |
| 17 | 75.5 | 18.0 | 6.0 | 0.5 | | | | 170 | — | −1.5 | 24.0 |
| 18 | 75.0 | 10.0 | 9.7 | 5.0 | 0.3 | .0005 | | 135 | — | −1.4 | 22.0 |

In Table 4, the symbol "--" means "no significant hardening", or "hardness of less than 15% of its indicated annealed hardness".

Alloy 12 has about 75.0% gold, about 13.0% silver, about 8.0% copper, and about 4.0% zinc. This alloy had an annealed hardness of about 140 VHN, and was not capable of being age-hardened to a value greater than 15% of its annealed hardness.

Alloy 13 has about 75.0% gold, about 9.0% silver, about 8.7% copper, about 7.0% zinc, about 0.3% cobalt, and about 0.005% iridium. This alloy had an annealed hardness of about 135 VHN, and was not capable of being age-hardened to a value greater than 15% of its annealed hardness.

Alloy 14 contained about 75.0% gold, about 8.5% silver, about 10.0% copper, and about 7.5% zinc. This alloy had an annealed hardness of about 160 VHN, and was capable of being age-hardened to about 190 VHN.

Alloy 15 contained about 75.0% gold, about 14.5% silver, about 7.5% copper, and about 3.0% zinc. This alloy had an annealed hardness of about 150 VHN, and was not capable of being age-hardened to a value greater than 15% of its annealed hardness.

Alloy 16 contained about 75.0% gold, about 16.2% silver, about 7.3% copper, and about 1.5% zinc. This alloy had an annealed hardness of about 160 VHN, and was not capable of being age-hardened to a value greater than 15% of its annealed hardness.

Alloy 17 contained about 75.5% gold, about 18.0% silver, about 6.0% copper, and about 0.5% zinc. This alloy had an annealed hardness of about 170 VHN, and was not capable of being age-hardened to a value greater than 15% of its annealed hardness.

Finally, Alloy 18 contained about 75.0% gold, about 10.0% silver, about 9.7% copper, about 5.0% zinc, about 0.3% cobalt, and about 0.0005% iridium. This alloy was found to have an annealed hardness of about 135 VHN, and was not capable of being age hardened to a value greater than 15% of its annealed hardness.

Therefore, the present invention broadly provides various improved 18-karat green gold alloy compositions that broadly comprise: about 75.0% gold; about 6.0–7.0% silver; about 9.0–11.7% copper, and about 6.5–9% zinc. The improved alloys are capable of being age-hardened to a hardness of at least about 240 VHN by being heated to about 550° F. for about one hour, and thereafter being permitted to cool in air. The improved alloys may further contain about 0.3% cobalt and/or about 0.005% iridium. The improved alloys may further comprise about 0.5–1.9% indium. In each case, the improved alloys are capable of being selectively reversibly hardened and softened between their annealed and aged-hardness values by the appropriate indicated heat treatment. In other words, the alloys may be age-hardened by heating to about 550° F. for about one hour, thereafter allowing the alloys to cool in air. Conversely, the alloys may be reduced to their annealed hardness by heating to about 1150° F. for about thirty minutes, followed by quenching in water. Thus, the improved alloys have reversible hardnesses between their annealed and aged values, and exhibit desirable green gold color within the color limits specified herein.

Therefore, while several preferred compositions have been shown and described, and several modifications thereof discussed, persons skilled in this art will readily appreciate that various additional changes and modifications may be made without departing from the spirit of the invention, as defined and differentiated by the following claims.

What is claimed is:

1. An 18-karat green gold alloy composition, comprising:

about 75.0% gold;

about 6.0–7.0% silver;

about 9.0–11.7% copper;

about 6.5–9.0% zinc; and wherein the hardness of said composition is capable of being selectively changed between its annealed-hardness value obtained by heating said composition to about 1150° F. for about thirty minutes followed by a water quench, and its aged-hardness value obtained by heating said composition to about 550° F. for about one hour and thereafter being permitted to cool in air and wherein the color of said composition is between about 1.5 to about −3.0 CieLab a* color units, and between about 19 to about 26 CieLab b* color units.

2. An 18-karat green gold alloy composition as set forth in claim 1, and further comprising:

about 0.3% cobalt.

3. An 18karat green gold alloy composition as set forth in claim 1, and further comprising:

about 0.005% iridium.

4. An 18karat green gold alloy composition as set forth in claim 1, and further comprising:

about 0.5–1.9% indium.

5. An 18karat green gold alloy composition as set forth in claim 1 wherein said aged-hardness value is at least about 240 VHN, and wherein said annealed hardness value is about 50–75% of said aged-hardness value.

6. An 18karat green gold alloy composition as set forth in claim 1 wherein said composition contains about 7.0% silver, about 10.7% copper, about 7.0% zinc, about 0.3% cobalt, and about 0.5% indium.

7. An 18karat green gold alloy composition as set forth in claim 1 wherein said composition contains about 7.0% silver, about 10.2% copper, about 7.0% zinc, and about 0.3% cobalt.

* * * * *